United States Patent [19]

Tonkens

[11] Patent Number: 5,042,091

[45] Date of Patent: Aug. 27, 1991

[54] GARMENT TISSUE DISPENSER AND METHOD

[76] Inventor: Rosalie R. Tonkens, 211-22 Melville Loop, Chapel Hill, N.C. 27514

[21] Appl. No.: 515,823

[22] Filed: Apr. 27, 1990

[51] Int. Cl.[5] ..... A41D 1/00

[52] U.S. Cl. ..... 2/94; 2/247; 2/249; 2/250; 2/DIG. 6; 2/DIG. 7

[58] Field of Search ..... 2/94, 49 R, 249, 250, 2/DIG. 6, DIG. 7, 247

[56] References Cited

U.S. PATENT DOCUMENTS 2,651,039 9/1953 Tonkens et al. ..... 2/49 R
3,624,686 11/1971 Beals ..... 2/DIG. 6
4,718,124 1/1988 Sawicki et al. ..... 2/DIG. 7
4,835,821 6/1989 Durante ..... 2/DIG. 6

*Primary Examiner*—Werner H. Schroeder
*Assistant Examiner*—Gloria Hale
*Attorney, Agent, or Firm*—Kahrl, Thomas A.

[57] ABSTRACT

A packet container for tissues for attachment to a garment for patients particularly old patients, specially adapted for use by a user who is immobilized in a chair or confined as an invalid in a bed by attaching the packet to the users garment, normally a gown or pajamas. The packet is constructed of a transparent material on the front panel to display the within contained package of tissues with an access opening and having a back panel provided with hook and loop attachment means for selectively attaching the packet to the users garment for use by the wearer or by an attendant.

6 Claims, 1 Drawing Sheet

GARMENT TISSUE DISPENSER AND METHOD

BACKGROUND OF THE INVENTION

It is well known that tissue dispensers are very useful in providing readily available absorbent tissue for use by invalids or by those persons caring for infants or invalids or elderly patients. Such dispensers to be useful must be conveniently located adjacent the individual user. Normally tissue dispensers are located in the bathrooms or bedroom dressers or vanity tables typically out of sight, yet reasonably available for those persons in need of the use of tissues, who are normally active. However with patients, particularly elderly patients who lack mobility, placement of tissues dispensers must be located as near to the patient as practical, particularly if they are in a wheel chair or hospital bed which may be moved or elevated in a way to render side tables inaccessible to the patient. Furthermore for persons providing care for a multitude of patients, frequently situated in a variety of rooms, each having a different place where a tissue dispenser, it is often very frustrating and time consuming to search the premises to locate a tissue dispenser as needed.

The unitary bib and tissue dispenser as illustrated in U.S. Pat. No. 2,651,039 is so constructed to provide a fixed tissue dispenser fastened in one central position on a baby bib. Any packet of tissues placed in the packet provided tend to remain with the bib during use and until exhausted. It is desirable to provide for a new and improved garment tissue dispenser which provides easy access by a user or an attendant wherever the patient is located.

SUMMARY OF THE INVENTION

The invention relates to a garment tissue dispenser. In particular the invention concerns an improved container for holding a packet of absorbent tissues for attachment to a garment, particularly a smock type garment normally worn by patients or invalids which dispenser provides easy access to tissues to be used as needed by the user or attendant.

The garment tissue dispenser as hereinafter described and illustrated is an improvement of the bib and dispenser as illustrated in U.S. Pat. No. 2,651,039 in that the present invention is directed to a tissue garment dispenser where the container is in a form of a removably mounted container for use on a plurality of garments, such garments being suitably fitted with a fleece segment attached to the chest portion of the garment for attaching [fastening] the tissue garment dispenser to. Furthermore the tissue garment dispenser is designed to be used on a smock type garment worn by elderly patients rather than by infants, which garments are washed daily and hence would require frequent removal of the container of tissues. Furthermore unlike the current invention the prior art was intended to be used by infants and thus the container was firmly secured at all times to the bib, otherwise it would have been quickly and enthusiastically removed by the wearer of the bib.

The improved garment tissue dispenser is adapted to hold a packet in close fitting relationship containing tissues for removable attachment to a garment for patients particularly older patients and is particularly adapted for use by a user who is immobilized in a chair or confined to a bed, by attaching the dispenser to his or her garment at a convenient location typically on the upper chest portion of the garment, the garment normally being a gown, smock or pajamas. The dispenser comprises a container constructed of transparent plastic material on the front panel to display the within contained package of tissues, having an elongated slit access opening for insertion and removal of the tissue pack and a back panel provided with a fastener means, typically hook material attached to the panel for selective attachment of the packet to the users garment in the area of the fleece material segment for access to the within contained absorbent tissues by the wearer or by the attendant.

The front panel is secured to the rear panel, typically by stitching to provide a container for receiving a packet of tissues such as a packet of Kleenex R in the size of $2\frac{1}{2}'' \times 4\frac{1}{2}'' \times 1''$. The garment will be described for the purposes of illustration only in connection with certain embodiments however, it is recognized that various changes, corrections, additions, modifications and improvements may be made by those persons skilled in the art, all falling within the spirit and scope of the invention as illustrated.

DESCRIPTION OF THE EMBODIMENTS

Figure 1:
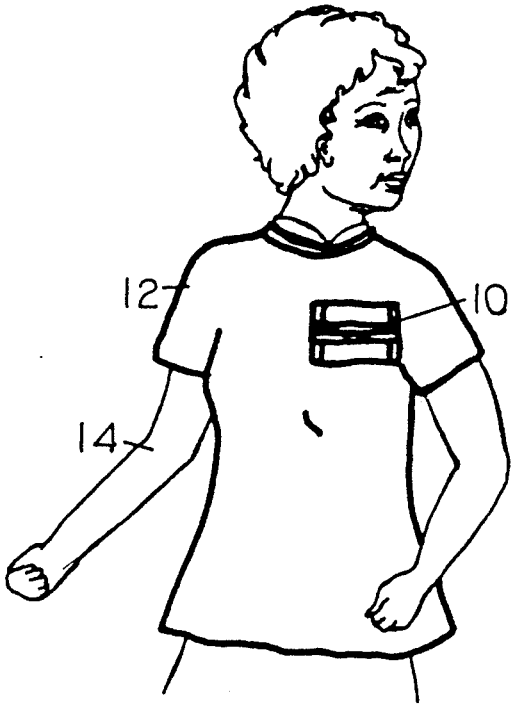
FIG. 1 is an illustrated perspective view from the front of the garment tissue dispenser of the invention as attached to a garment worn by a user.
Figure 4:
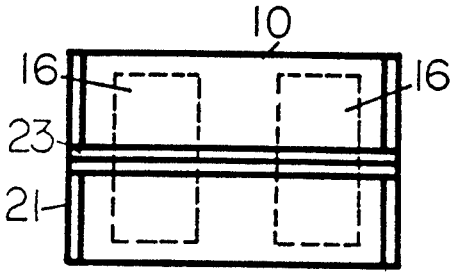
FIG. 4 is a front plan view of the invention shown in FIG. 3 shown separately from the garment.
Figure 2:
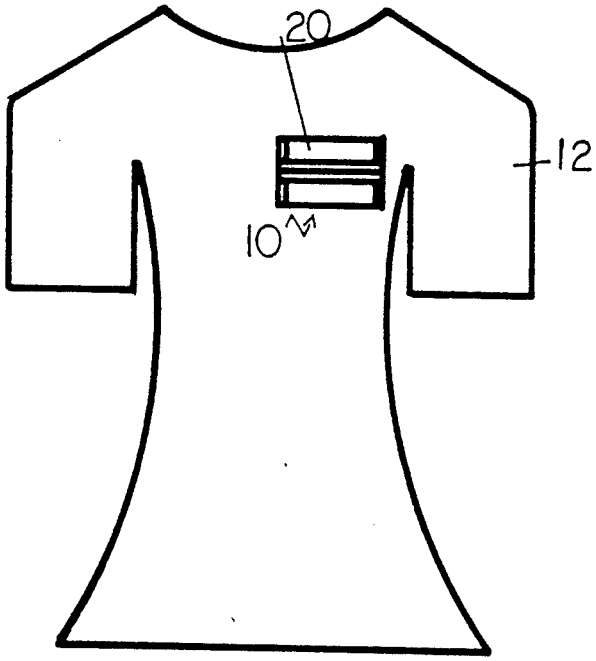
FIG. 2 is a view of a garment view of the invention attached to a garment shown in the front position.
Figure 3:
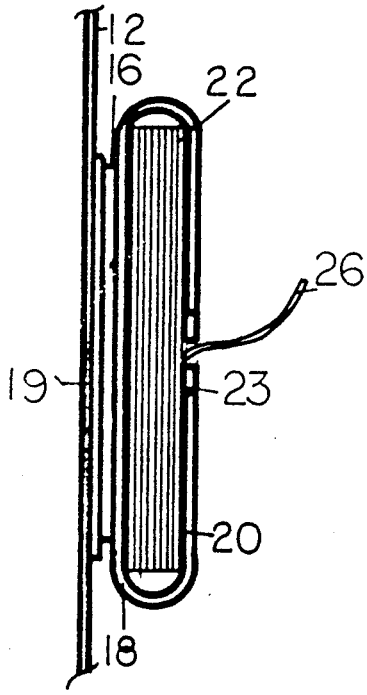
FIG. 3 is a side view of the invention shown in FIG. 2 in attachment with the garment shown in FIG. 2.

With reference to the drawings there is shown and illustrated a garment dispenser 10 attached to a garment 12 to be worn by a patient 14. The garment dispenser 10 includes a plurality of fastener means 16 attached to the back panel 18 of the garment dispenser 10 the garment dispenser 10 is attached to the garment 12 by means of securing the fastening means to a section of fleece pile [20] 19 secured to the garment 12 at the option of the user. The garment dispenser 10 comprises [a] the back panel 18 integrally fastened by side fastener means 21 with a front panel 20, the front panel having an elongated slot 23 for permitting a pack of tissues 22 to be inserted therein and individual tissues 26 to be withdrawn by a user as shown in FIG. 3.

What is claimed is:

1. A tissue dispenser adapted to hold a packet of tissue for attachment to a garment which comprises;

a) a garment to be worn by a user;

b) a garment fastener means to be attached to the garment for providing a mounting surface;

c) a packet of tissue of generally rectangular construction containing a plurality of folded absorbent tissues;

d) a tissue dispenser means constructed of transparent plastic material for receiving the packet of tissue and permitting tissues to be dispensed therefrom comprising a front panel of generally rectangular construction for fitting in close relationship with the packet consisting of transparent sheet material having a one end and other end and a first and a second longitudinal side characterized by an elongated central slit opening, extending along the longitudinal axis of the panel, a rear panel of generally rectangular construction consisting of transparent sheet material having a one end and other end and a first and second longitudinal side the first side being integrally joined to the first side of the front panel by a fold and the second longitudinal side being joined to the front panel by a longitudinal fold, and side wall fastening means for fastening the one end of the front panel to the one end of the rear panel and the other end of the front panel to the other end of the rear panel;

e) a dispenser fastening means mounted on the rear panel of the tissue dispenser for fastening to the fastener means attached to the garment wherein the garment tissue dispenser means may be placed over the fastener means for removable mounting of the tissue dispenser means.

2. The tissue dispenser of claim 1 wherein the garment fastener means comprises a segment of fleece material to be securely attached to the garment.

3. The tissue dispenser of claim 1 wherein the dispenser fastener means comprises a plurality of fastener segments constructed of hook fastener material.

4. The tissue dispenser of claim 1 wherein the garment is constructed in the form of a smock suitable for use by patients.

5. A garment tissue dispensing system comprises a tissue dispenser of claim 1 and in combination;

a) a garment to be worn by a patient;

b) a garment fastener means constructed of fleece material attached to the garment.

6. A method of dispensing tissues from a holder attached to a garment;

a) providing a garment having an attachment means;

b) providing a tissue dispenser to receive a packet of tissues having a front panel with an elongated access slot and a rear panel including fastening means;

c) inserting a packet of tissues in the pouch;

d) attaching the pouch by releasable means to the garment by securing the releasable attachment means to the attachment means secured to the garment.

* * * * *